US006514379B1

(12) United States Patent
Gartz et al.

(10) Patent No.: US 6,514,379 B1
(45) Date of Patent: Feb. 4, 2003

(54) PROCEDURE FOR ARRANGING WATER CIRCULATIONS IN INTEGRATED PAPER MILL

(75) Inventors: Rainer Gartz, Kotka (FI); Sakari Kaijaluoto, Jyväskylä (FI); Kari Kokkonen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/706,168

(22) Filed: Nov. 3, 2000

(30) Foreign Application Priority Data

Nov. 3, 1999 (FI) ..... 992376

(51) Int. Cl.[7] ..... D21C 11/00

(52) U.S. Cl. ..... 162/29; 162/41; 162/189; 210/928

(58) Field of Search ..... 162/29, 190, DIG. 8, 162/189, 41; 210/928

(56) References Cited

U.S. PATENT DOCUMENTS 5,302,246 A 4/1994 Nykanen et al. ..... 162/29
5,540,816 A 7/1996 Andtbacka et al. ..... 162/29
5,746,886 A * 5/1998 Backlund et al. ..... 162/30.1
5,853,535 A * 12/1998 Maples et al. ..... 162/30.1
5,961,784 A 10/1999 Heikkilä et al. ..... 162/189
5,968,317 A * 10/1999 Gartz et al. ..... 162/190
6,071,380 A * 6/2000 Hoffman ..... 162/190
6,190,504 B1 * 2/2001 Karlsson et al. ..... 162/190

FOREIGN PATENT DOCUMENTS

WO 9744522 11/1997
WO 9946443 9/1999

* cited by examiner

*Primary Examiner*—Dean T. Nguyen
(74) *Attorney, Agent, or Firm*—Steinberg & Raskin, P.C.

(57) ABSTRACT

A procedure for arranging water circulations in an integrated paper mill, the paper making process of which having three partly separate process phases concerning the water circulations (I, II, III). In the first phase, the fiber raw material is pretreated, defibered and cleaned for producing mechanical, chemi-mechanical and recycled pulp, in the second phase the pulp is treated further for improving the quality, and in the third phase it is made into paper or board. The circulation waters of the first process phase are concentrated by circulating the filtrates of the concentration and pressing phases counter-current inside the water circulation (I), and the circulation water thus concentrated is conducted into an effluent evaporation plant to be concentrated and then burnt in a combustion boiler. The water quantity discharged from the water circulation (I) of the first process phase is replaced by conducting such circulation waters of the paper mill into the front dilution of the press.

16 Claims, 6 Drawing Sheets

PROCEDURE FOR ARRANGING WATER CIRCULATIONS IN INTEGRATED PAPER MILL

FIELD OF THE INVENTION

The present invention relates to a procedure for arranging water circulations in an integrated paper mill, including a pulp mill based on refiner mechanized pulp and/or groundwood pulp and/or waste paper and/or chemical pulp, and paper and/or board manufacturing lines.

BACKGROUND OF THE INVENTION

Various impurities enter the water circulations in a paper mill in different phases of the pulp and paper production process. Fouling of water is mainly caused by organic ingredients accumulating from fiber raw material and, on the other hand, mainly by inorganic chemicals added therein in different phases. As unwanted chemical agents, such impurities, in high proportions, are detrimental to the operation of the process and the quality of the paper produced.

A paper making process can be divided into two or three main phases being partly separate in water circulations, the first phase thereof including pretreatment, defibering and cleaning of fibre raw material and preferably also pulp thickening and pressing. The second phase includes improving of pulp quality, and paper manufacture. Currently, also the water circulation of the paper manufacture has been separated, whenever needed, from the water circulation of the quality improvement phase into a third water circulation by arranging pulp thickening and/or pressing between the process phases. The second quality improvement phase includes, depending on the need, pulp processing phases such as dispersing, bleaching and sorting.

The pretreatment may include various operations, such as barking, washing of chip, thermal and chemical treatment, waste paper pulping and pulp cleaning.

In pretreating raw material, namely in the defibering, pulping and cleaning phases, addition of chemicals can be employed, or the phases can be carried out without any chemicals. When producing mechanical pulp, about 2 to 5 per cent of the wood material is dissolved or dispersed as colloid particles in the process water. Most of the process water fouling takes place in connection with chip treatment and defibering, whereby, for instance, the water coming from the mass suspension of a TMP grinder contains dissolved and colloid organic matter in great quantities. Moreover, when using waste paper, paper fillers and additive agents from the raw material end up into the circulation water in the defibering and cleaning phases, in addition to organic agents, additive agents used in converting paper, and completely foreign agents accumulated in the use or recycling of paper. Particularly difficult foreign agents are sticky agents which are adhesive in nature and originated from various adhesives and plastics.

Inorganic chemicals enter the water circulation in the pulp quality improvement phase, in bleaching and in the wet end of the paper machine, in which phases also organic matter is dissolved. In addition, in different phases of producing recycled mass, chemicals are used in great quantities e.g. for chalking print dye pigments, as auxiliary foaming agents, in pulp bleaching, and in end acidification.

In different phases of a paper making process, great quantities of water are needed for various purposes, such as for dilution of pulp and chemicals, transport and cleaning. In addition, water is needed e.g. for cooling and sealing. By circulating the process waters of the paper mill, endeavors are made to recover and to reuse the useful ingredients originated from the process and contained in the circulation water, such as fibers, fines, filling agents and paper making chemicals, as well as heat. Some of the water needed by the paper mill is generally provided from outside the mill as raw water which has to be cleaned prior to introduction to use and heated if need be to appropriate temperature. Clean water is needed e.g. for certain washing jets in the paper machine and for dilution of chemicals.

In order to maintain the contents of unwanted agents below the risk limits, fresh water is usually brought into the process at the same time as part of the circulation water is removed from the system as effluent. When the paper mill process waters are generally circulated counter-current from the paper machine towards the pulp mill, the organic and inorganic agents entered in the circulation water in different phases of the process are usually concentrated most in the circulation and effluent waters of the defibering phase of the pulp. On the other hand, the organic and inorganic matter released in different process phases travels to some extent downstream together with the pulp to the paper machine, which travelling is attempted to be reduced by the thickening, dilution and pressing apparatus positioned between the pretreatment, defibering and cleaning phases and the pulp quality improvement phase, which systems have currently been positioned, whenever needed, also between the pulp quality improvement phase and the paper making phase. With the aid of presses, the pulp can be thickened, depending on the apparatus, to about 25 to 35% thickening, whereas the thickening achieved with the aid of thickening apparatus is only about half thereof.

In Finnish patent applications Nos. 962176, 962177, 062178, an arrangement is described in which some of the fresh water amount usually needed by the paper mill is replaced by jet waters selectively recovered from the waters fouled in the paper mill and by waters to be cleaned locally, and the concentrates thus obtained from the water cleaning phases are utilized whenever appropriate by making them flow counter-current relative to the raw material flow for reuse in the paper mill, by means of which measures the level of the quantities of unwanted agents circulating in the paper mill is controlled. By said arrangement, unwanted agents are transferred counter-current from the water circulation of the paper machine into the water circulation of the pulp mill, wherefrom they can be conducted to an effluent evaporation plant and concentrated for combustion at the same time as the cooling water circulation of the evaporation plant is advantageously connected to the cooling and jet water system of the paper mill and the clean condensate is conducted as jet water for substitution of fresh water.

The organic and inorganic matter circulates in due time in the water circulations of the mill and is finally discharged from the process mainly among the effluents and to a lesser extent with the paper and into the atmospheric air. The main fractions of the effluents are formed by the controlled overflow of the filtrate of the circulation water system of the pretreatment /defibering /cleaning phases and by the reject waters of the cleanings of the pulp and the water circulations in different phases, in addition to which sporadic emissions occur to some extent.

Pressure towards reducing the consumption of fresh water by closing water circulations are on one hand caused by the costs of raw water and the effluent, and on the other hand, by the availability of raw water and by the emission restrictions concerning effluents. A complete shut-off of a paper mill is not possible because emissions of effluents are needed for removal of unwanted agents from the process. When reducing the consumption of the fresh water entering into the water circulation of the paper machine mainly through jets and dilution targets, an excessive temperature rise and concentration of colloid and dissolved organic and inorganic unwanted agents, particularly salts, in the water circulations of the paper machine and of the pulp mill may become a problem to the extent which is detrimental to the quality and production of pulp and paper. If e.g. the content of unwanted agents in the circulation water of the paper machine is increased too much, the action of the retention chemicals will be weakened, the formation of interfiber bonds will be impaired and the strength of paper being manufactured will suffer. A first drawback lies therein, that for instance with the increased content of the agents dissolved in the circulation water used for pulp bleaching, the degree of brightness may drop or the consumption of bleaching chemicals may grow, which, in turn, will increase the amount of organic and inorganic matter ending up in the circulation and effluent waters.

With the most commonly used water purification methods within the paper mill, fibre, pigment, resin or sticky agent particles are in general removed using filtering, clarification and flotation techniques. However, removal of unwanted colloid agents is incomplete, and separation of dissolved agents hardly ever occurs, instead, the agents travel into different fractions mainly in proportion of liquid flows. A more thorough removal of colloid matter and dissolved organic and inorganic matter requires costly special arrangements such as membrane filtering and/or evaporation.

By evaporation, biologically undecomposable organic matter, micromolecular agents and volatile components and salts can be removed from the unclean water, the separation whereof would otherwise be difficult. The water achieved through evaporation may be even purer than the chemically treated fresh water. The use of evaporation as a process-internal water cleaning method is particularly advantageous when the waters being cleaned are warm and concentrated, and the process yields waste heat in great quantities appropriate for use as an energy source. Utilization of waste heat can advantageously be intensified by means of surface condensation and cooling tower connection of the evaporation as disclosed in FI patent application No. 962178. When the filtrate of the thickening phase subsequent to the defibering is strong and hot, owing to the counter-current connection of the circulation waters, and its quantity is small, it is advantageous to lead it to the evaporation plant to be concentrated further. From the evaporation plant the concentrated solution can be conducted to the combustion unit, whereby the organic matter is utilized in the energy production of the paper mill and the inorganic matter, such as sodium and sulphur, in the chemical circulation of the mill. The foul condensates of the evaporation plant can be conducted to biological effluent treatment.

In manufacturing mechanical pulp, great quantities of expansion steams are formed, for instance, in making refiner mechanical pulp, about 2 tons of steam are released per pulp ton. Another drawback lies therein, that merely 1 ton of pure steam per mass ton can be produced with expansion steam with the aid of a steam generator, said steam being used in the process for replacing fresh steam. The rest of the thermal energy of the expansion steam is wasted in heat losses and discharged with the unclean condensate into the circulation waters and effluents.

In a paper mill provided with conventional counter-current connection of circulation waters, the effluents contain great quantities of inorganic salts, a majority of which being compounds melting at a low temperature, such as sodium. Another drawback in this case is that an effluent concentrate cannot be burnt together with mill waste or other fuel in the ancillary boiler available which can be of grate type, or nowadays most frequently, fluidized bed or circulated type, in which sodium and potassium cause sintration of bed sand and chloride, boiler corrosion. Yet another drawback is that burning such concentrate requires a soda boiler which may not always be available in conjunction with the mill. Another drawback is that in such instances detrimental and corroding unwanted agents, such as potassium and chloride, may be concentrated into the chemical circulation of the pulp mill. When the bleaching waters of pulp mills are concentrated and conducted into a soda recovery boiler, endeavors are made to reduce concentration of said agents by means of crystallization techniques and by opening chemical and water circulations. Another drawback is that the evaporation concentrate has a low dry matter content (20 to 40%), and decreases the efficiency of the electricity and steam production of the high-pressure ancillary boiler or soda recovery boiler.

OBJECTS AND SUMMARY OF THE INVENTION

The object of the present invention is to achieve a procedure, with the aid of which the above drawbacks can be avoided and simultaneously, the water consumption of the paper mill and effluent emissions can be reduced.

Another object the present invention is to achieve a procedure with which the combustion of agents ending up in the concentrate of the effluent evaporation plant, utilization of combustion waste or the amount of agents detrimental to recovery of chemicals can be limited.

Yet another object of the present invention is to achieve a procedure with the aid of which the contents of colloid and dissolved organic and inorganic unwanted agents can be reduced in the water circulations of the pulp quality improvement phases and of the paper machine when reducing the fresh water consumption of the mill.

A further object of the present invention is to provide for a more efficient utilization of the heat of expansion steams of the process and the condensate and energy contents of effluents.

In the procedure according to the present invention, the circulation water of the water circulation of the first process phase is concentrated by circulating the filtrate of the pulp thickening phase after the defibering and cleaning phases back into the pretreatment and defibering of the raw fiber material. The concentration of the circulation water is intensified by adding the dilution and pressing of the pulp after the pulp thickening phase after the cleaning. In addition, a second pulp dilution/press phase can be added in the process immediately after the defibering. The water circulation of the first process phase is separated into a water circulation of its own, within which the overflow connection between the water circulations of the thickening phases is arranged counter-current relative to the pulp flow so that the filtrate of the pressing passes into the pulp dilution on the front side of the thickening and the filtrate of the thickening goes into the dilution of the pulp prior to potential pressing after the defibering. The pretreatment of the raw material may comprise, for instance in chip treatment, removal of impurities and washing, absorption and heat treatment with the aid of water and steam and/or with the aid of chemicals, whereto the filtrate from the pressing and/or thickening is conducted. The pretreatment of raw material may also include other operations such as barking or waste paper pulpering and cleaning.

The strongest filtrate obtained as overflow of the pretreatment and from pulp pressing and/or thickening after the defibering phase is concentrated in the evaporation plant and the concentrate burnt.

The evaporation concentrate can be burnt in a fluidized or circulated bed type ancillary boiler when chemicals harmful to combustion or causing corrosion are not conducted into the first water circulation, nor the circulation waters including such agents are not conducted counter-current relative to the traveling of the pulp or from the water circulations of the paper machine or the quality improvement phase.

The evaporation concentrate can be burnt in a soda recovery boiler when a concentrate contains, due to the chemical selections of the process phases or the water connections, compounds melting at low temperature, such as sodium, but not in excessive quantities corrosion-causing chemicals or chemicals detrimental to recovery of chemicals and unwanted agents.

The evaporation concentrate can be dispersed into drops or burnt in a melt fuel furnace with auxiliary fuel when the concentrate contains compounds causing corrosion or melting at low temperature when it should not cause harm to the burning, chemical circulation or efficiency of power production. The inorganic molten salts obtained from the bottom of the furnace can be dissolved in residual water to be taken into biological purification or solidified into solid state to be taken to recycling or to a dump in separation or mixed with other waste.

For the energy source in the effluent evaporation plant, electricity, steam and preferably the hot, unclean waste steams of a refiner plant or a pressure grinding plant can be used, being conducted through steam wash directly into the evaporation phase. With the aid of steam wash, the fibre matter is prevented from entering on the heat-exchange surfaces of the evaporation plant. In this manner both the amount and the heat of expansion steams of the pulp production and the heat content of the effluent can be utilized more efficiently than before. The clean condensate formed from unclean steams and circulation water is used for pulp dilution prior to the press phase. The unclean condensate formed in cleaning the main condensate is conducted into the effluent treatment together with the reject fractions of the first process phase. The water quantity leaving the water circulation together with the pulp, entering into the effluent and the atmospheric air, is replaced by other waters free from said detrimental agents, such as by the circulation water of the paper manufacturing, but not by the bleaching water of the quality improvement phase containing sodium in great quantities. Preferably, clean cooling water heated in the cooling/condensing apparatus can be used for this purpose. Said make-up water together with the clean condensate is conducted into the pulp dilution prior to the pressing preceding the quality improvement phase, whereby the washing of pulp is carried out preferably with water which is as clean as possible.

The pulp can be properly washed, in this manner, before the bleaching or dispersing of the pulp quality improvement phase, which will improve the quality of pulp and paper, especially clearness and microbiological purity, reduce the quantities of detrimental agents transferring to the paper machine and the use of chemicals, and water emissions from the water circulations of the quality improvement phase and the paper machine. The overflow of the paper machine water circulation is conducted primarily into the dilution before the pressing of the pulp after the quality improvement phase. Between said phases, the counter-current principle can thus be maintained, so that the effluent formed therefrom is mainly comprised of controlled overflow of the filtrate of the quality improvement phase, reject waters of the phases, and spurious emissions.

From about 50% to a majority of the organic effluent load of the plant is dissolved in the first water circulation being separated as a separate water circulation. When said effluent is concentrated by evaporation into a small volume and the concentrate is burnt, the energy content of the organic matter can be recovered. Hereby, also the amount of the water to be discharged as effluent from the process is reduced, as well as the amount of agents difficult to decompose biologically or of those agents which will not decompose, so that the efficiency of the biological treatment is improved and problems related to sludge elimination are reduced.

The procedure of the invention is advantageously appropriate for use in an integrated paper mill in which the use of expansion steams of thermomechanical pulp and pressure groundwood can be intensified by conducting them into an effluent evaporation plant, but the procedure is also applicable in a mill utilizing waste paper as raw material, when the water circulation to be concentrated includes a pulp concentration phase after the cleaning, and the dilution and pressing, or, in addition thereto, as an advantageous embodiment, a second pulp dilution and pressing immediately after the pretreatment, pulpering and defibering phases. For the evaporation energy, electricity, fresh steam and thermal energy partly recoverable from flue gases can be used.

When the waste paper mass is washed according to the invention as early as in the first process phase on the counter-current principle two or three times, the ending up of impurities with the pulp in the paper machine is lessened radically. In the pulp thickening and/or pressing subsequent to the second, that is, the quality improvement process phase, the circulation water conducted from the third process phase, that is, the water as a controlled overflow from the paper machine, is advantageously used for the front dilution water. The discharge of impurities is also increased in that the water circulation of the pulp mill is in this manner divided into two parts in separation from each other, and the effluent of the second water circulation, that is, of the pulp improvement phase, is conducted into an external effluent treatment plant. When at this stage the counter-current principle is abandoned, the impurities ended up in the circulation waters in the second and the third phase of pulp production, such as sticky agents which are known to be very harmful in the production of recycled pulp and dispersed in the water in the dispersing phase, are not returned unpurified into the process, instead, they can be discharged efficiently.

BRIEF DESCRIPTION OF THE DRAWINGS

The invention is described below in greater detail with the aid of FIGS. 1–6, to the details of which the invention is not intended to be restricted.

DETAILED DESCRIPTION OF THE INVENTION

Figure 1:
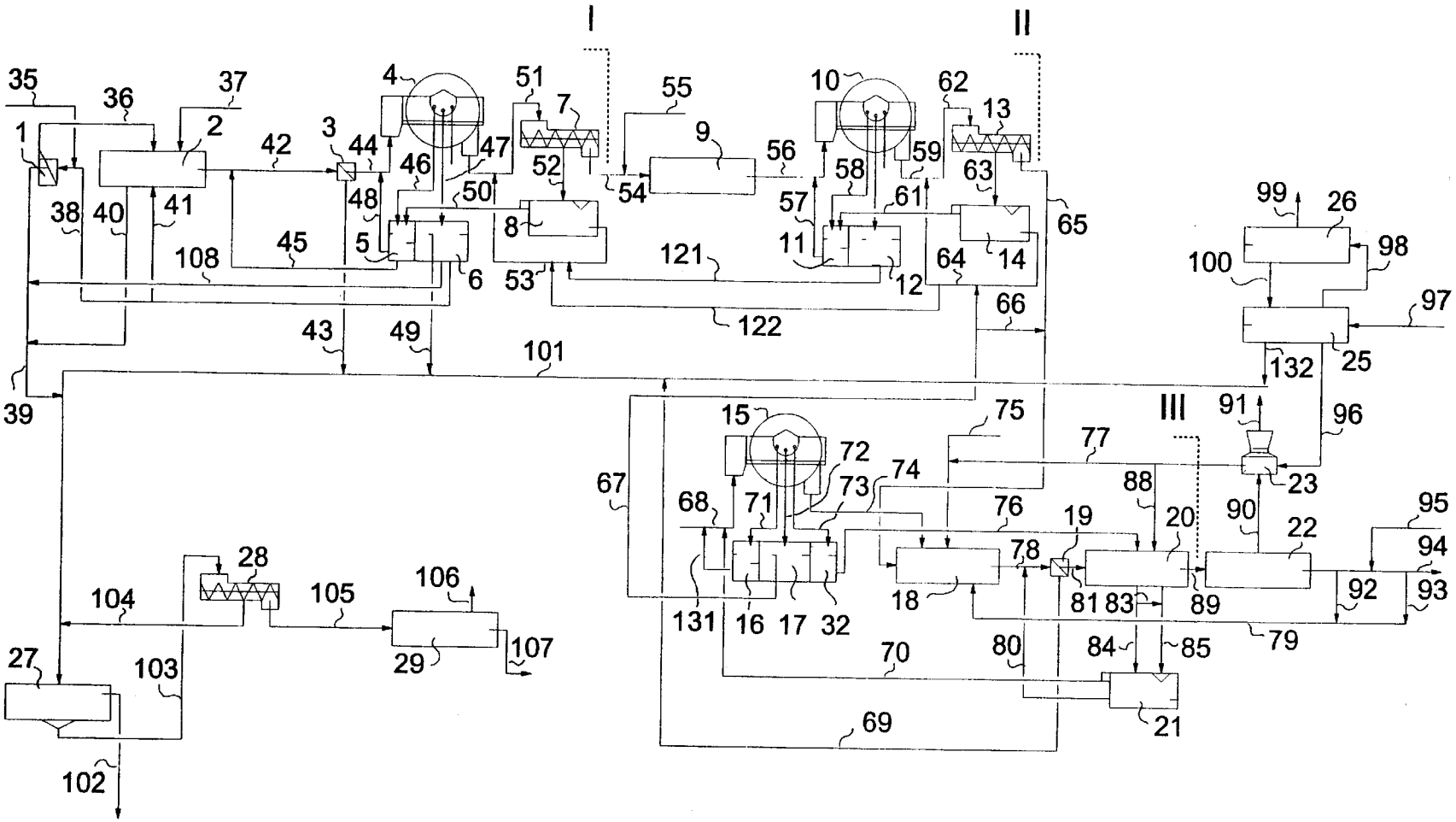
FIG. 1 is a schematic drawing represents a water circulation system of a paper mill according to the present state of the art.

FIG. 1 represents a water treatment circulation system for a paper mill according to the present state of the art. The paper making process and its water circulation are for the purposes of illustration divided into three consecutive parts I, II and III, the limits whereof being marked with broken lines. On the left side of each broken line is located said part of the water circulation marked with numeral I, II III.

As a main principle known in the art, the first process phase includes the following main phases: pretreatment of raw material 1, defibering 2, cleaning of pulp 3, thickening 4, and 5 pressing 7. The water circulation I of the first process phase includes moreover circulation water tanks 5, 6 and 8. The second process phase includes pulp quality improvement 9, thickening 10 and pressing 13, and its water circulation II includes further circulation water tanks 11, 12 and 14. In the third process phase, the paper making is carried out in the paper machine, the main phases of which are indicated by reference numerals 18, 19, 20 and 22. The water circulation III of the third process phase includes circulation water tanks 16, 17, 32 and 21, and a disc filter 15. The overflows 121 and 122 of the water circulations II and III are conducted counter-current relative to the pulp travelling to the water circulation I, and the concentrated effluent 39, 49 is discharged from the water circulation I to an effluent treatment plant 27. The effluent treatment plant 27 and the reject slurries 39, 43, 69, 132, 103 are concentrated with a sludge press 28 and burnt in a residue combustion boiler 29, located in the site or outside. Inorganic matter is discharged from the water circulation mainly together with the effluent 102 into the waterways. The consumption of fresh water in an exemplary modem plant is about 10 $m^3$/paper ton and the chemical oxygen use load of the effluent into an effluent treatment plant is about 21 t/24 hrs and into the waterways about 4 t/24 hrs.

First, the progress of the fibre matter is described more in detail below in FIG. 1. The fibre raw material is brought via connector 35 to the raw material pretreatment phase 1, wherefrom it passes via connector 36 to the defibering 2 and, further, along connector 42 to the pulp cleaning 3. Thereafter, the pulp passes along connector 44 to the thickening 4 and therefrom along connector 51 to the press phase 7. Via connector 54 the pulp enters the quality improvement phase 9, wherefrom it passes along connector 56 to the thickening 10 and therefrom, along connector 62 to the press phase 13. Via connector 65, the pulp is conducted to the pulp unit 18 of the paper machine, wherefrom it passes along connector 78 to the cleaning 19 and therefrom along connector 81 to the paper machine wire section and press section, that is, to the wet end 20, wherefrom the paper web 89 formed from the pulp is transferred to the drying section 22. Uncoated reject 92 is separated from the paper web. Subsequent to the drying section 22, coating 95 is brought onto the paper web, and from the coated paper web 94, coated reject 93 is separated. The rejects are conducted along connector 79 to the pulp section 18.

Secondly, the progress of the waters of the water circulation III presented in FIG. 1 is described in more detail below. The fresh water enters along connector 97 to the water cleaning 25, wherefrom cold water runs along connector 98 to the cooling system 26. Therefrom, some of the water is discharged in the form of vapor 99 into the outdoor air, and the returning of cooling water is conducted in heated state along connector 100 through the water cleaning 25 and connector 96 to the heat recovery section 23 of the paper machine, which transfers heat from the wet discharge air 90 of the drying section 22 into fresh water passing to the fresh water jets of the paper machine along connector 88 and into the dilution of chemicals, and for use as sealing and make-up water along connector 77. Via a discharge connector 91 of the heat recovery unit 23, water steam is discharged into the atmospheric air.

From the wet end 20 of the paper machine, the filtrate water and the jet waters are collected along connectors 83, 84, 85 to the short-circulation water system 21, wherefrom circulation water is taken along connector 80 for the dilution of the pulp 78 on the way to the paper machine. The excess water of the short circulation is conducted along connector 70 to a disc filter 15 and mixed with auxiliary pulp brought to the disc filter 15 along line 68. The solid matter recovered by the disc filter 15 passes along connector 74 to the pulp section 18, the turbid filtrate passes along connector 71 into a turbid filtrate tank 16 and the clear filtrate along connector 72 to a clear filtrate tank 17, and the super clear filtrate along connector 73 to a super clear filtrate tank 32. The circulation water from the turbid filtrate tank 16 runs along connector 131 to the front dilution of the disc filter 15 and it is mixed with the auxiliary pulp brought along line 68. From the super clear filtrate tank 32, the circulation water passes along line 76 to the paper machine. From the clear filtrate tank 17, circulation water of the water circulation III is conducted along connector 67 via a pulp collecting connector 66 from the press 13 along line 65 to the collection of the entering pulp, and the excess is conducted to the front dilution line 64 of the press 13 and along connector 122 to the water circulation II, into the front dilution line 53 of the press 7.

Third, the progress of the waters of the water circulation II presented in FIG. 1 is described below more in detail. Filtrate from the press 13 passes along connector 63 into a filtrate tank 14, wherefrom circulation water is taken along connector 64 for the dilution of the pulp entering the press 13 via line 62. The overflow of the filtrate tank 14 passes via the turbid filtrate tank 11 of the disc filter 10 along connector 57 into the dilution of the pulp 56 entering the filter. The pulp concentrated by the disc filter 10 passes along connector 62 to the press 13, the turbid filtrate passes along connector 58 into the turbid filtrate tank 11 and the clear filtrate along connector 59 into the clear filtrate tank 12. From the clear filtrate tank 12 the overflow passes along connector 121 into the front dilution line 53 of the press 7.

Fourth, the progress of the waters of the water circulation I presented in FIG. 1 is described below more in detail. The filtrate from the press 7 passes along connector 52 to a filtrate tank 8, wherefrom circulation water is taken along connector 53 to the dilution of the pulp entering the press 7 along line 51. The overflow of the filtrate tank 8 passes via connector 50 and via the turbid filtrate tank 5 of the disc filter 4 along connector 48 to the pulp dilution when passing through the connector 42 and the cleaning 3 along connector 44 to the concentration 4. The pulp concentrated with the disc filter 4 passes along connector 51 to the press 7, the turbid filtrate via connector 46 to the turbid filtrate tank 5 and the clear filtrate via connector 47 to the clear filtrate tank 6. From the clear filtrate tank 6, circulation water is conducted to the raw material pretreatment 1 along connector 38 and into the defibering 2 along connector 41. The overflow of the tank 6 is conducted via connector 49 into the drain 101.

Fifth, the effluent treatment presented in FIG. 1 is described below more in detail. The overflow 49 of the water circulation I and the reject waters 39, 43, 69, 132 from different process phases are conducted via the drain 101 to an effluent treatment unit 27, wherefrom the sludges are conducted along connector 103 to a sludge press 28, and the purified effluent via a discharge connector 102 into the waterways. The filtrate from the sludge press 28 is returned to the effluent treatment 27 along connector 104, and the concentrated sludge enters along connector 105 into a residue combustion boiler 29, wherefrom steam is discharged along with flue gases 106 into the atmospheric air. The inorganic matter of the chemicals separated from the raw materials 35, 95 of the paper making process and brought into the process via connectors 37, 55, 75 is discharged via connector 107 together with the ash. The consumption of fresh water is about 10 $m^3$/paper ton and the chemical oxygen consumption load of the effluent into the effluent treatment unit is about 21 t/24 hrs, into the waterways about 4 t/24 hrs.

Figure 2:
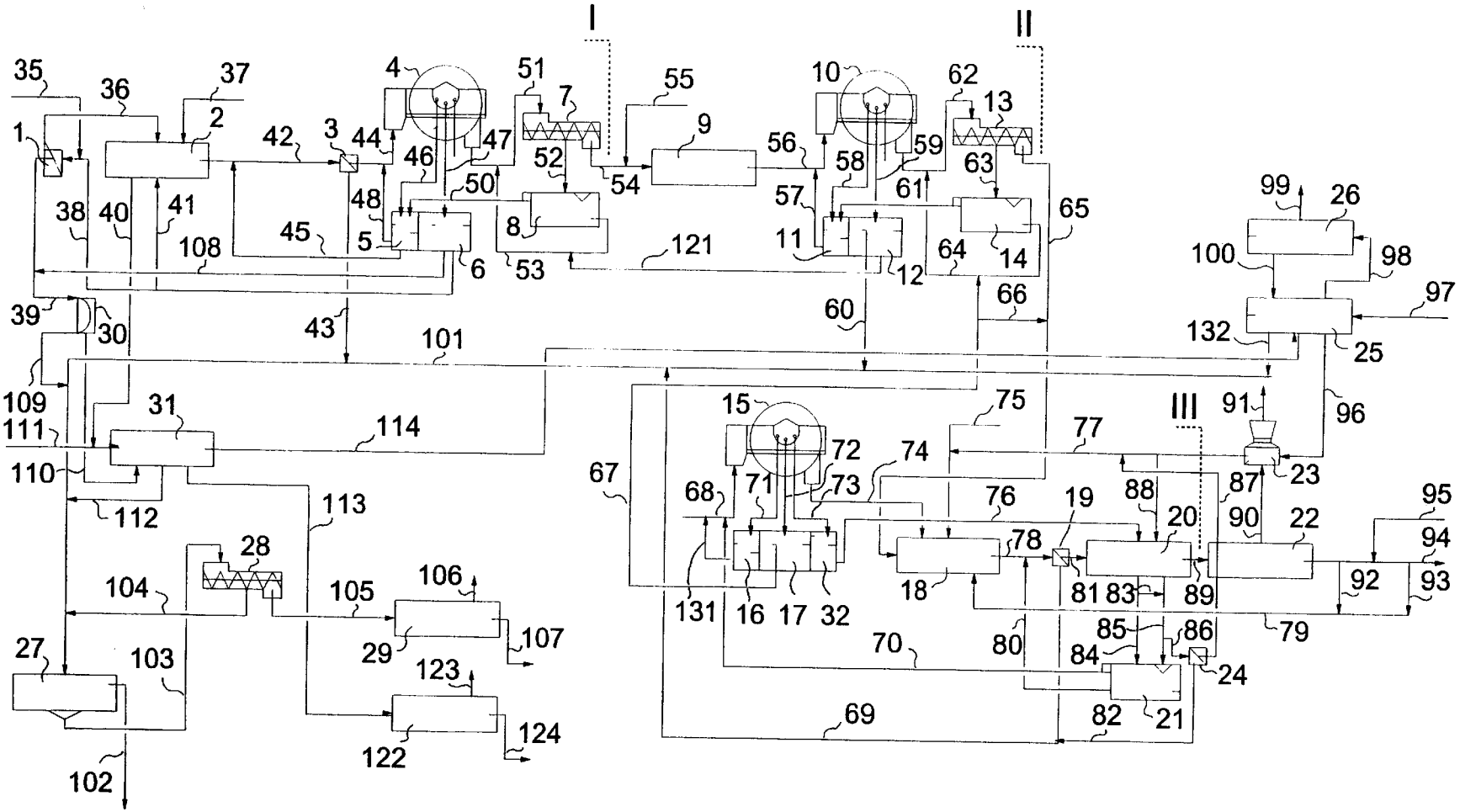
FIG. 2 is a drawing of a more advanced version of the paper mill presented in FIG. 1.

FIG. 2 presents an enhanced process, which is based on the design as in FIG. 1 but which on the basis of the FI patent applications Nos. 962176, 962177, 962178 have been improved by changes described more in detail below. Some of the fresh water amount 96 needed by the paper mill is replaced by paper machine jet waters 83, 88 recovered selectively, being conducted along connector 86 to a local purification unit 24, and from there along connector 87 to a fresh water line 77 to replace fresh water in appropriate targets, these being, for instance, dilution of chemicals, sealing and make-up waters, and paper machine jets. The overflow of the water circulation III is conducted along line 67 counter-current relative to the course of the pulp to the water circulation II, the overflow of which passes along line 121 counter-current relative to the course of the pulp to the water circulation I and it is concentrated in the defibering and pretreatment phases 1 and 2. Some of the concentrated and heated filtrate passes along connector 108 to the overflow of the pretreatment 1, from where the fractions pass along connector 39 via a solid matter filter 30 and connector 110 to an effluent evaporation plant 31. The concentrate of the effluent evaporation plant 31 is conducted along connector 113 for burning in a soda recovery boiler 122 located in site or elsewhere, and the clean condensate is conducted along connector 114 via the water treatment 25 and connector 96 to the paper machine. The unclean condensate of the effluent evaporation plant 31 is conducted via connector 112 to the drain 101. In the evaporation 31, the heat and amount of the expansion steams conducted via connector 40, preferably directly from the defibering 2, and the heat content of the effluent obtained via connector 110 are utilized. If needed, the need of energy of the evaporation 31 can be complemented with fresh steam or electricity along connector 111. From the clear filtrate tank 6 of the water circulation I no concentrated filtrate is conducted directly into the drain 101. The purification plant slurries and reject slurries 43, 69, 103, 109, 82, 132 are concentrated with a sludge press 28 and burnt in the residue combustion boiler 29, wherefrom steam is discharged together with flue gases 106 into the atmospheric air. The inorganic matter of the sludges is discharged via connector 107 together with ash. The inorganic matter of the chemicals separated from raw materials 35, 95 and entered via connectors 37, 55, 75 enters with the concentrate along connector 113 into the soda recovery boiler 122, and it is recovered into the chemical circulation via connector 124. Depending on the evaporation quantity, the consumption of fresh water is about 4–5 $m^3$/paper ton and the chemical oxygen consumption load of the effluent into the effluent purification plant is 6–11 t/24 hrs, into the waterways about 1–2 t/24 hrs, and into the soda recovery boiler about 10–15 t/24 hrs. In the present instance and in those below, the evaporation quantity is varied in the range 20 to 30 liters per second.

Figure 3:
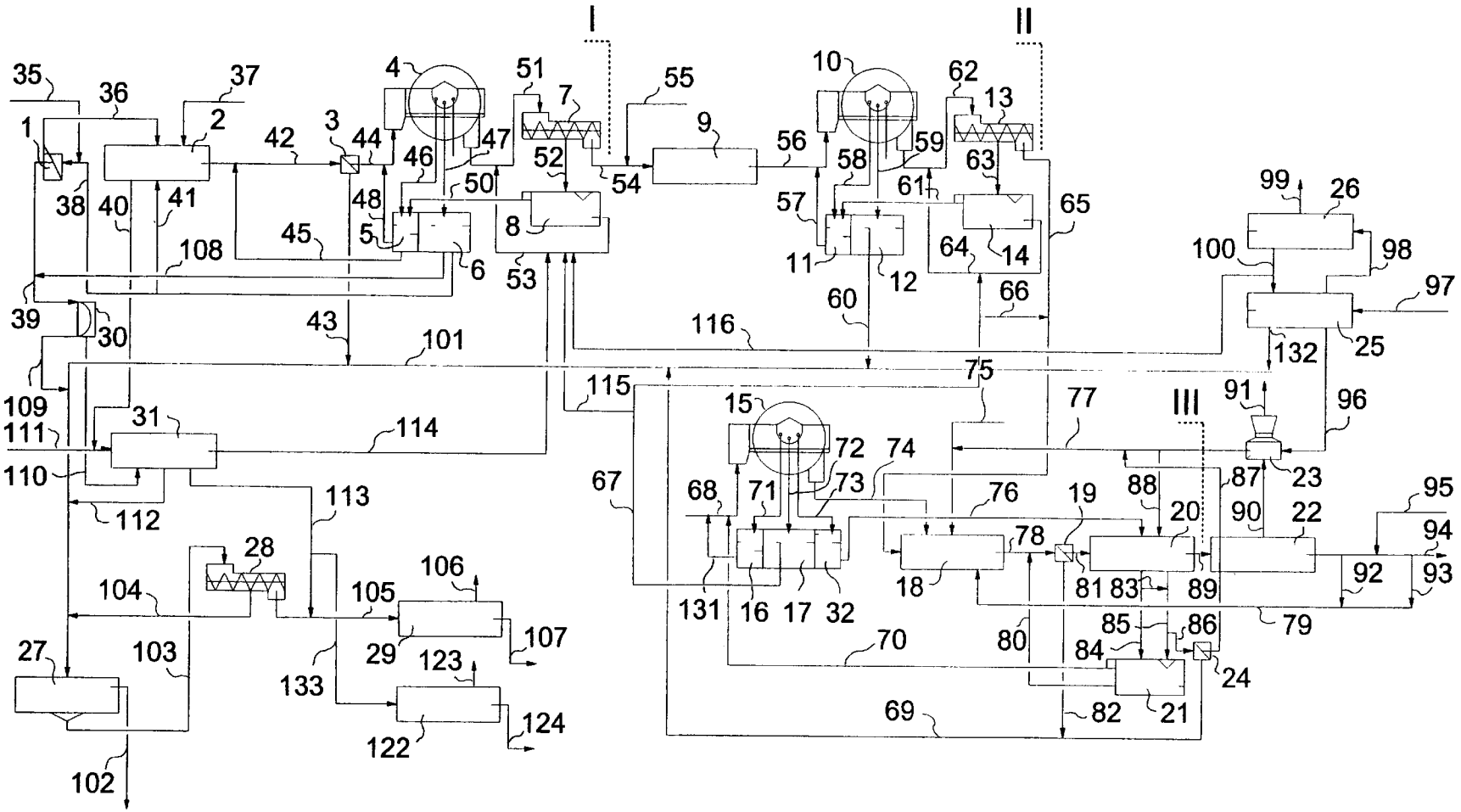
FIG. 3 is a schematic drawing of an example of the arrangement of the circulation of water according to the present invention.

FIG. 3 presents a procedure of the invention which is based on the designs as in FIGS. 1 and 2 but which has been improved by means of changes described more in detail below. The water circulation I is separated into a separate water circulation ending in the thickening 4 and the press 7. On the front side of the press 7, clean condensate of the effluent evaporation plant 31 is conducted into the pulp dilution—washing line 53 along connector 114. In addition, circulation water from the water circulation I is conducted for make-up water into the dilution—washing line 53 along connector 115 when it contains no chemicals harmful to combustion in an ancillay or soda recovery boiler. If needed, make-up water can be conducted into the dilution—washing line 53, additionally or solely, along connector 116 from the cooling water system 26 in line 100 of discharging clean and warm cooling water. The make-up water replaces the water balance difference discharging from the water circulation I through connectors 40, 43, 54, 109, and when it is conducted to the front side of the press 7 together with the clean condensate 114 of the evaporation plant 31 to pulp dilution washing, the running of unwanted agents into the pulp quality improvement phase 9 and to the paper machine can be essentially reduced. In the exemplary case, the chemical oxygen consumption of the filtrate of the press 7 is about 1,900 to 2,000 mg/l in the process of FIG. 1, about 4,000 to 6,000 mg/l in the process of FIG. 2 depending on the amount of evaporation, and with the process connection of the invention presented in FIG. 3, it is about 2,100 to 3,400 mg/l depending on the amount of evaporation.

The effluent concentrated in the water circulation I is discharged through connector 110 to the effluent evaporation plant 31, wherefrom the concentrate is conducted along connector 113 for combustion in the residue combustion boiler 29 or along connector 133 for combustion in a soda recovery boiler. The type of the boiler to be used in burning the concentrate is on one hand dependent on whether a residue combustion boiler or a soda recovery boiler is available, and on the other hand, also on the pulping process used. If chemicals containing sodium and sulphur are used in the pulping process, the soda recovery boiler is most appropriate for recovering the chemicals. The essential feature of the invention lies in that the entry of agents harming combustion, utilization of combustion residue and/or recovery of chemicals is limited into the water circulation I. Harmful agents are at least chlorides and to some extent also potassium and silicates. The overflow 60 of the water circulation II is conducted via the drain 101 to the effluent treatment plant 27. The fresh water consumption is about 7 $m^3$/paper ton and the chemical oxygen consumption load of the effluent into the effluent treatment plant is about 11 to 14 ton/24 hrs, depending on the amount of evaporation, about 2 to 3 ton/24 hrs into the waterways, and about 7 to 10 ton/24 hrs into either boiler.

Figure 4:
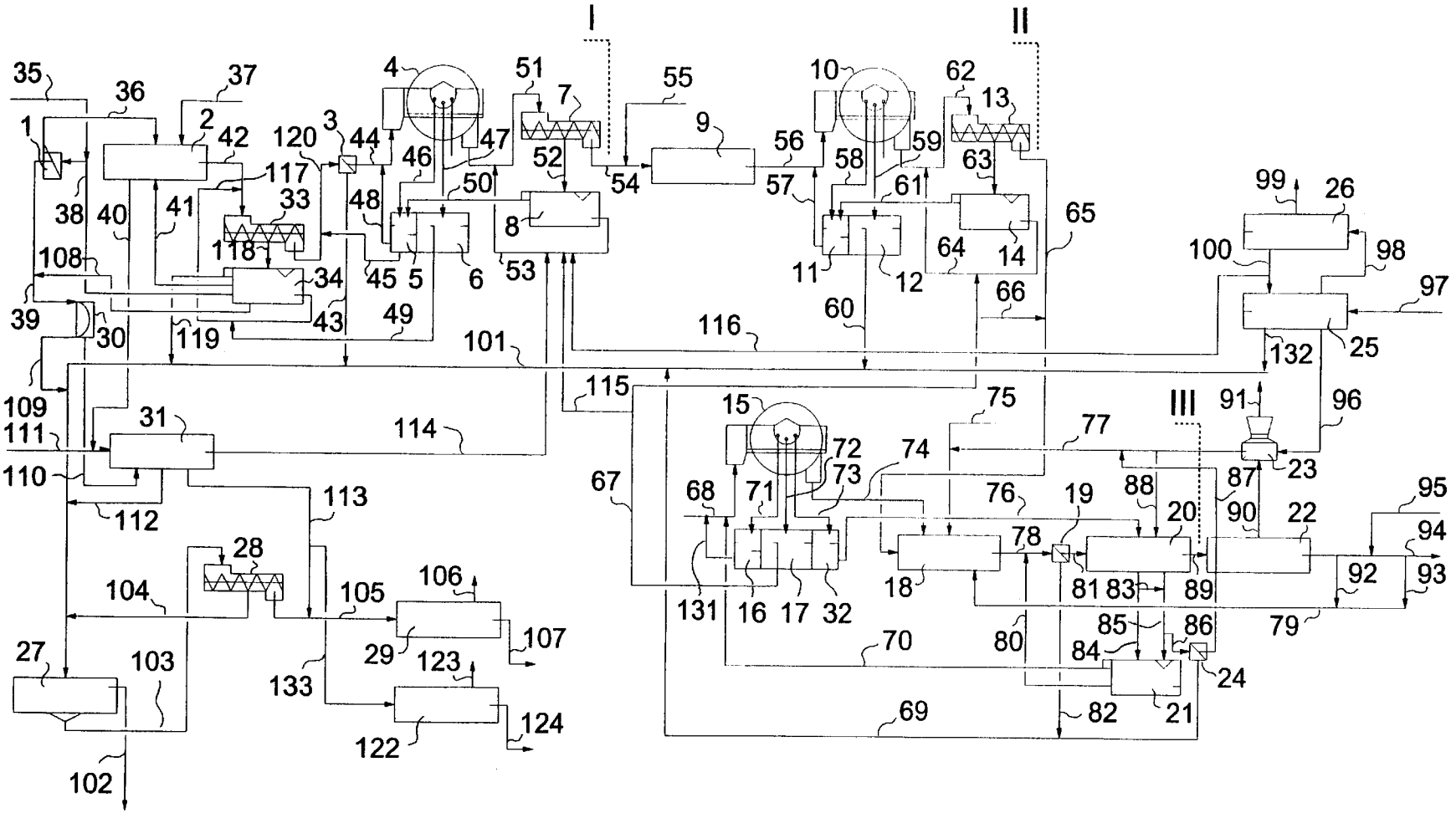
FIG. 4 is a schematic drawing of a second embodiment according to the present invention for arranging the circulation of water in a paper mill.

FIG. 4 presents a second embodiment of the procedure of the invention, based on the designs shown in FIGS. 1, 2 and 3 but improved by changes described more in detail below. Regarding FIG. 3, an additional dilution and a press 33 have been added in the water circulation I for the pulp entering along connector 42 immediately after the defibering 2, the filtrate whereof passing along connector 118 through a filtrate tank 34 and connector 117 to the front dilution of the pulp. The pulp is discharged from the press 33 along connector 120 and it is diluted with turbid filtrate conducted from the turbid filtrate tank 5 along connector 45 prior to being conducted via the purification 3 along connector 44 to the disc filter 4. From the clear filtrate tank 6 of the filter 4, make-up water is conducted into the water circulation 117 of the press 33 via connector 49. Within the water circulation I, an overflow connection 50, 45, 49 between the water circulations of the thickening phases 7, 4, 33 is arranged counter-current relative to the traveling of the pulp so that the filtrate 52, 50 of the press 7 preceding the pulp quality improvement phase 9 passes to the pulp dilution on the front side of the thickening 4 along connector 45, and the filtrate 47 of the thickening passes to pulp dilution prior to the press 33 after the defibering 2 along connector 49, 117. In this manner, the effluent within a water circulation can be concentrated to a greater extent than earlier before it is discharged along connector 110 to the effluent evaporation plant 31. Simultaneously, the pulp can be washed better than earlier in the press 7 before the pulp quality improvement phase 9. The chemical oxygen consumption of the filtrate of the press 7 is, in the exemplary case in the process of FIG. 4, only about 1,000 to 1,800 mg/l depending on the amount of evaporation. Travelling of unwanted agents into the pulp quality improvement phase and to the paper machine will in this manner be reduced highly significantly, which is assumed to have a considerable impact on the quality of pulp and paper, production and chemical consumption. The fresh water consumption is about 7 $m^3$/paper ton and the chemical oxygen consumption load of the effluent into the effluent treatment plant is about 10 to 12 t/24 hrs, depending on the amount of evaporation, about 2 to 2.5 t/24 hrs into the waterways and about 9 to 11 t/24 hrs into the combustion, either into the residue combustion boiler 29 or into the soda recovery boiler 122.

Figure 5:
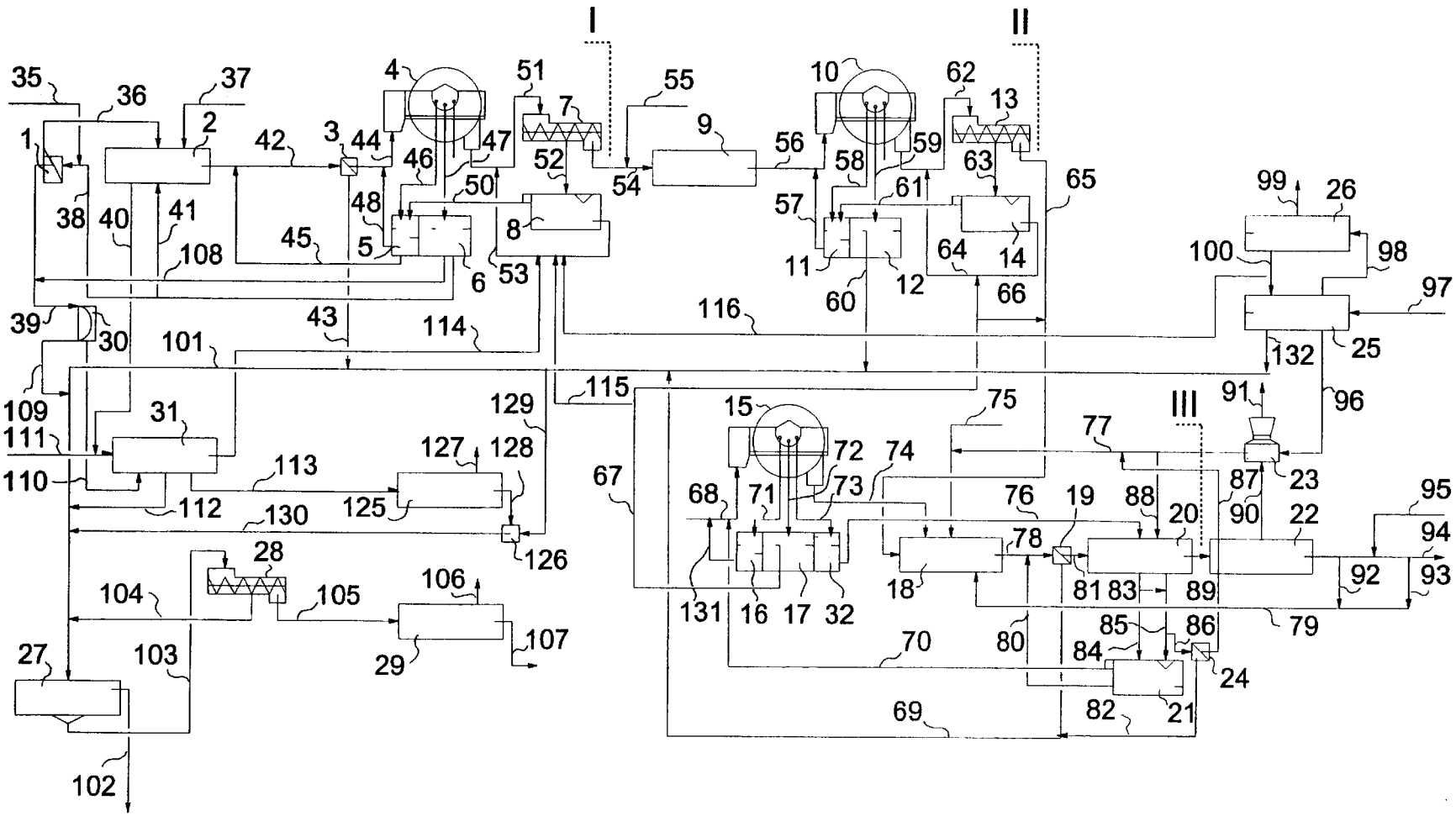
FIG. 5 is a schematic drawing of a third embodiment according to the present invention for arranging the circulation of water in a paper mill.

FIG. 5 presents a third embodiment of the procedure of the invention, based on designs in FIGS. 1, 2, 3 and 4 but improved by means of changes described more in detail below. The evaporation concentrate coming from the evaporation plant 31 along connector 113 is disintegrated into drops and burnt with auxiliary fuel in the melt combustion furnace 125 when the concentrate contains corroding compounds or those melting at low temperature, which are not desired to cause any harm to combustion, chemical circulation or the effectiveness of the power production of the residue combustion boiler 29 and the soda recovery boiler 122 shown in FIGS. 2 and 4. The inorganic salts entering, in molten state from the bottom of the furnace 125 along connector 128, into the dissolving unit 126 can be dissolved into the partial flow of the effluent entering along connector 129, which takes the inorganic salts into biological purification along connector 130. The salts can also be taken out from the melt combustion furnace 125 along connector 128 and solidified into solid state for recovery or taken to a dumping area separately or mixed with other residue. The fresh water consumption is about 5 to 7 $m^3$/paper ton and the chemical oxygen consumption load of the effluent into the effluent purification unit is about 6 to 12 t/24 hrs depending on the amount of evaporation and the target for the clean condensate, about 1 to 1.25 t/24 hrs into the waterways and about 9 to 15 t/24 hrs into the melt combustion furnace.

Figure 6:
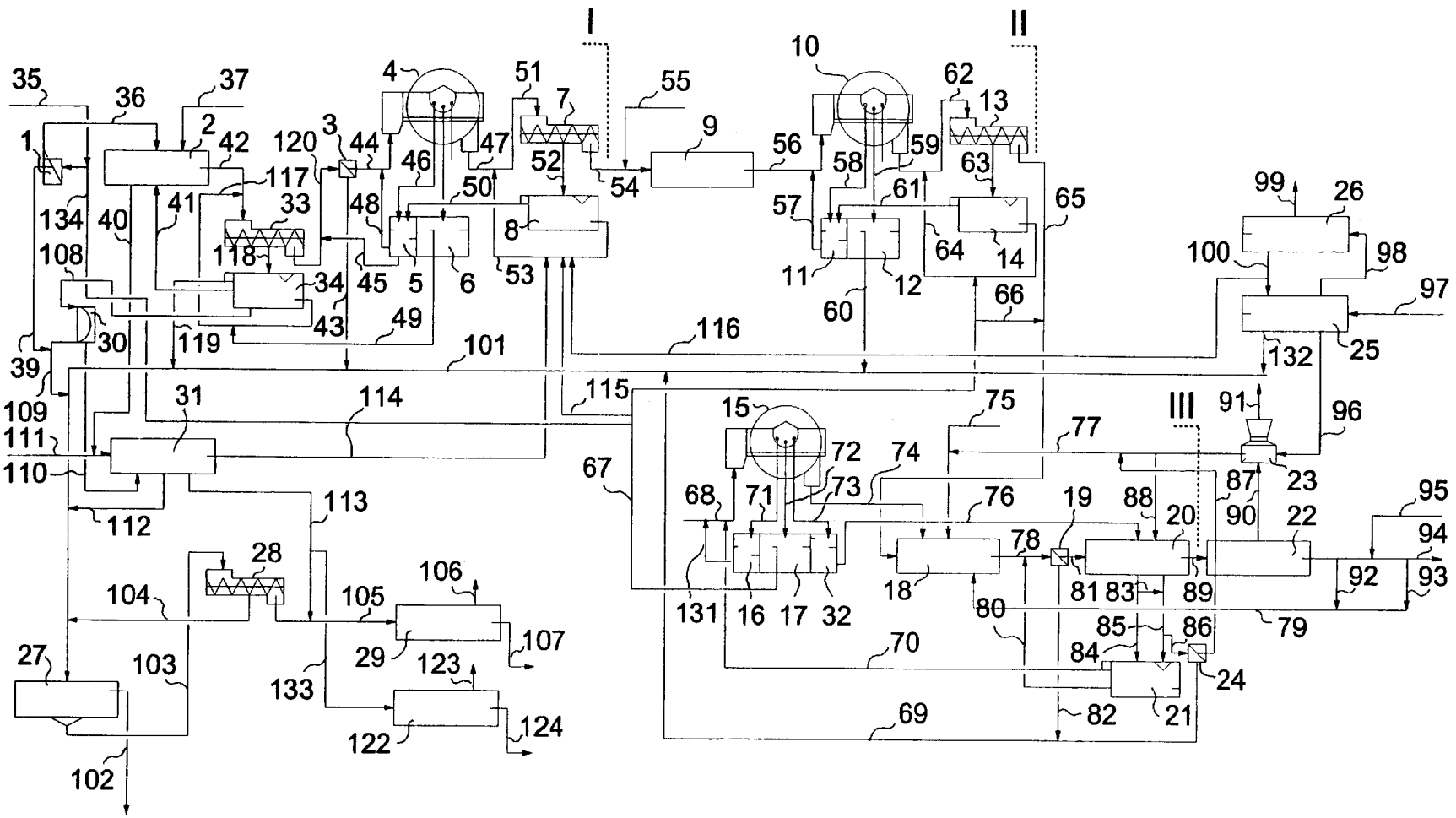
FIG. 6 is a schematic drawing of a fourth embodiment according to the present invention for arranging the circulation of water in a paper mill.

FIG. 6 presents a fourth embodiment of the procedure according to the invention, based on the designs presented in FIGS. 1, 2, 3, 4 and 5 but improved by means of changes described more in detail below. As shown in the figures, the circulation water 39 of the raw material pretreatment 1 is separated from the circulation water of the water circulation I passing to the evaporation plant 31 along line 108. Circulation water passes to the pretreatment I from the filtrate tank 17 of the water circulation III along connectors 67 and 134, but it can also be taken from the filtrate tank 12 of the water circulation II. Circulation water passes to the evaporation plant 31 from the filtrate tank 34 along connector 108 to the solid matter filter 30 and therefrom along connector 110. If there is no press 33 and filtrate tank 34 available, the circulation water is taken into connector 108 from the filtrate tank 6 shown in FIGS. 2, 3, 4 and 5. Hereby, from the inorganic matter entering the residue combustion boiler 29, the soda recovery boiler 122 or the melt combustion furnace 125 the inorganic matter can be separated when coming from the raw material pretreatment 1. In addition, the chemical oxygen consumption of the concentrate on the way to the combustion is greater by about 0.1 to 0.5 t/24 hrs, owing to the concentration of the water circulation I. The chemical oxygen combustion load to the waterways is smaller by an equal amount.

The invention is described above referring merely to the advantageous embodiment examples thereof, to the details of which the invention is not, however, intended to be exclusively restricted. A number of modifications and variations are conceivable within the scope of the inventive idea of the claims below. As such, the examples provided above are not meant to be exclusive and many other variations of the present invention would be obvious to those skilled in the art, and are contemplated to be within the scope of the appended claims.

We claim:

1. A procedure for arranging water circulations in an integrated paper mill the paper making process of which is divided into three partly separate process phases considering the water circulations (I,II,III) of which:

in the first process phase, the fibre raw material is pretreated, defibered and cleaned for producing mechanical, chemi-mechanical or recycled pulp, in the second process phase, the pulp is treated further for improving the quality thereof and in the third process phase, the braked pulp is made into paper or board in a paper or board machine, in which process, between the first and the second process phases, pulp thickening (4) and pressing (7) are arranged, wherebetween the pulp is diluted with water (53) which is cleaner than the filtrates (46, 47, 52) of the thickening and press phases, the procedure comprising the steps of:

concentrating the circulation waters of the first process phase by circulating filtrates (46, 47, 52) of the thickening and pressing phases within the water circulation (I) of the first process phase countercurrent, and conducting the circulation water (110) thus concentrated into an effluent evaporation plant (31) to be concentrated to an effluent concentrate, the effluent concentrate (113) then being burn t in a combustion boiler (29, 122, 125) appropriate for the purpose;

replacing the water quantity discharged from the water circulation (I) of the first process phase by conducting into a front dilution (53) of the press (7) at least one circulation waters (114, 115, 116) of the paper mill which do not contain at least one of the chemicals harmful to combustion of the effluent concentrate (113), recovery of chemicals and utilization of combustion residue; and selecting chemicals that are not harmful to the combustion of said at least one of effluent concentrate (113), recovery of chemicals and utilization of combustion waste when chemical addition (37) is used in the first process phase.

2. The procedure according to claim 1, wherein the clean condensate (114) of the effluent evaporation plant (31) is conducted into the water circulation (I) of the first process phase for use in pulp dilution prior to the pressing phase (7).

3. The procedure according to claim 1, wherein from a cooling system (26) of the paper mill, heated cooling water (116) is conducted into the water circulation (I) of the first process phase for use in pulp dilution prior of the pressing phase (7).

4. The procedure according to claim 1, wherein in the effluent evaporation plant (31) heat generated and the amount of the hot and unclean expansion steams of a defibering (2) are directly utilized.

5. The procedure according to claim 1, further comprising:

arranging between the second and third process phases, pulp thickening (10) and pressing (13), wherebetween the pulp is diluted with water (67) taken from the water circulation (III) of the third process phase and being cleaner than a filtrates (58,59,63) of said thickening and pressing phases.

6. The procedure according to claim 1, further comprising:

adding an additional pressing phase (33) between the defibering (2) and the pulp thickening (4), the pulp entering said additional pressing phase being diluted with water (49) taken from the thickening (4) and being cleaner than the filtrate (118) of said pressing phase.

7. The procedure according to claim 1, further comprising:

burning the concentrate (113) of the evaporation (31) in a melt combustion furnace (125) thereby producing an inorganic melt matter, the inorganic melt matter (128) of which is then dissolved in the effluent (129) and conducted into the effluent purification (27).

8. The procedure according to claim 1, further comprising the step of:

separating the circulation water (39), coming from the raw material pretreatment (1), from the circulation water (110) by passing into the evaporation (31).

9. A method for arranging a first, second and third water circulation (I, II, III) in a papermaking process of an integrated paper mill having three partly separate process phases in which:

in the first process phase, a fiber raw material is pretreated, defibered and cleaned for the production of one of a mechanical, chemi-mechanical and recycled pulp, and in the second process phase, the pulp produced from the first process phase is further treated in order to improve the quality thereof, and in the third process phase, the pulp produced in the second process phase is made into paper or board in a paper or board machine; and wherein, between the first and the second process phases, pulp thickening (4) and pressing (7) are arranged, whereby the pulp produced in the first process phase is diluted with water (53) which is cleaner than a filtrate (46, 47, 52) produced from the thickening and press phases, the method comprising the steps of:

concentrating a first water circulation of said first process phase by circulating said filtrates (46, 47, 52) produced from said thickening and pressing phases within the water circulation (I) of the first process phase counter-current to produce a first concentrated circulation water;

conducting said first concentrated circulation water (110) into an effluent evaporation plant (31);

concentrating said first concentrated circulation water (110) in said effluent evaporation plant (31) to produce a first effluent concentrate (113);

burning said first effluent concentrate (113) in a combustion boiler (29, 122, 125);

replacing a quantity of water discharged from the first water circulation (I) of the first process phase by conducting at least one of a clean condensate (114) from said evaporation plant (31), a circulation water from said third water circulation (115) and a circulation water from a cooling water system (116) of the paper mill into a front dilution (53) of the press (7) which do not contain at least one of the chemicals harmful to combustion of the effluent concentrate (113), recovery of chemicals and utilization of combustion residue; and selecting chemicals that are not harmful to the combustion of said at least one of effluent concentrate (113), recovery of chemicals and utilization of combustion waste when chemical addition (37) is used in the first process phase.

10. The method according to claim 9, further comprising the step of:

conducting said clean condensate (114) of the effluent evaporation plant (31) into the water circulation (I) of the first process phase for use in pulp dilution prior to the pressing phase (7).

11. The method according to claim 9, further comprising the step of:

conducting a heated cooling water (116) from a cooling system (26) of the paper mill into the water circulation (I) of the first process phase for use in pulp dilution prior of the pressing phase (7).

12. The method according to claim 9, further comprising the step of:

directly utilizing heat generated in said effluent evaporation plant (31) and the hot and unclean expansion steams of a defibering (2) in the paper making process.

13. The method according to claim 9, further comprising the step of:

arranging between the second and third process phases, a pulp thickening (10) and a pulp pressing (13) of said second phase wherebetween the pulp is diluted with water (67) taken from the third water circulation (III) of the third process phase which is cleaner than a filtrate (58,59,63) of said thickening and pressing phases.

14. The method according to claim 9, further comprising:

adding an additional pressing phase (33) between the defibering (2) and the pulp thickening (4) of the first process phase, the pulp entering said additional pressing phase being diluted with water (49) taken from the thickening (4) of the first process phase and being cleaner than the filtrate (118) of said pressing phase of said first process phase.

15. The method according to claim 9, further comprising the step of:

burning the concentrate (113) of the evaporation (31) in a melt combustion furnace (125) thereby producing an inorganic melt matter; and dissolving said inorganic melt matter (128) in said effluent (129) and conducting said desolved melt matter into the effluent purification (27).

16. The method according to claim 9, further comprising the step of separating the circulation water (39) coming from a raw material pretreatment (1), from the circulation water (110) passing into the evaporation (31); and treating said water (39) separately.

* * * * *